US006134750A

United States Patent [19]

Salice

[11] Patent Number: 6,134,750

[45] Date of Patent: Oct. 24, 2000

[54] ADJUSTABLE HINGE ARM

[75] Inventor: Luciano Salice, Carimate, Italy

[73] Assignee: Arturo Salice S.p.A., Novedrate, Italy

[21] Appl. No.: 08/897,389

[22] Filed: Jul. 21, 1997

[30] Foreign Application Priority Data

Jul. 22, 1996 [DE] Germany ..... 296 12 684 U

[51] Int. Cl.[7] ..... E05D 7/04

[52] U.S. Cl. ..... 16/238; 16/246

[58] Field of Search ..... 16/238, 239, 240, 16/245, 246, 235

[56] References Cited

U.S. PATENT DOCUMENTS

| | | | |
|---|---|---|---|
| 4,011,627 | 3/1977 | Salice | 16/238 |
| 4,517,706 | 5/1985 | Lautenschlager et al. | 16/238 |
| 4,703,539 | 11/1987 | Lautenschlager, Jr. et al. | 16/240 |
| 4,799,289 | 1/1989 | Grass | 16/240 X |
| 5,056,190 | 10/1991 | Röck et al. | 1/1 |

FOREIGN PATENT DOCUMENTS

| | | |
|---|---|---|
| 7820305 U | 10/1978 | Germany . |
| 8209266 U | 6/1982 | Germany . |
| 3442421 | 1/1986 | Germany . |
| 3444994 | 6/1986 | Germany . |

*Primary Examiner*—Eric K. Nicholson
*Assistant Examiner*—David E. Bochna
*Attorney, Agent, or Firm*—Dilworth & Barrese

[57] ABSTRACT

An adjustable hinge arm with a U-shaped profile is supported on a base plate which can be fastened to a wall by its rear end portion remote from the joint and a setscrew screwed into this. A fastening screw is screwed into the base plate between the end portion and the setscrew. To allow in a simple design the angle of the hinge arm to the base plate to be adjusted for a side adjustment only by actuating a setscrew, a bottom plate is supported with its one end on the rear end section of the hinge arm, on the front end of which bottom plate the setscrew is pivoted and supported in an axially unmovable manner. The hinge arm is provided in the area of the fastening screw with a cutout in its leg portion. The fastening screw engages a hole in the middle section of the bottom plate and is supported with its head on the edge of said hole.

20 Claims, 4 Drawing Sheets

ADJUSTABLE HINGE ARM

BACKGROUND OF THE INVENTION

The invention relates to an adjustable hinge arm with a U-shaped profile which hinge arm is supported on a base plate which can be fastened on a wall or similar by its rear end section remote from the joint and a setscrew screwed into this end section, a fastening screw being screwed into the base plate between the end section and the setscrew. Due to production tolerances and imprecision in fitting, it is necessary during the fitting of such a hinge arm, for example to a piece of furniture, to be able to adjust the hinge arm in three directions where possible, namely in the depth of the piece of furniture and, additionally, in the height and in a lateral direction. The lateral direction is effected here by the setscrew, by which the hinge arm is swivelled around its support at its end section relative to the base plate.

In a hinge arm of the type first given known from DE-34 44 994 C2 its swivelling is effected by the fastening screw being supported with its head on the edge of an oblong hole of the leg section of the hinge arm, a washer made from an elastic and/or plastic material being inserted between head and oblong hole, which washer allows a swivelling of the hinge arm by the setscrew without any essential deformation of the edges of the oblong hole. However, the adjustment of the hinge arm by squeezing the washer is not a good solution as the adjustment area is only small and a loosening of the hinge arm can occur by turning back the setscrew to set a smaller angle of swivel.

From DE-34 42 421 A1 a hinge arm is known which is connected to the base plate via an intermediate plate which is, in turn, pivoted on the base plate, the angle of swivel being able to be set by a setscrew. This known hinge arm allows in a favorable manner a lateral adjustment of a door by swivelling the hinge arm, which adjustment is, however, achieved by a relatively complex design.

SUMMARY OF THE INVENTION

The object of the invention is therefore to provide a hinge arm of the type first given which in a simple design allows the setting of its angle to the base plate for lateral adjustment only by the actuating of a setscrew.

This object is solved in accordance with the invention in a hinge arm of the type first given by a bottom plate being supported on the rear end section of the hinge arm with its rear end, on whose front end the setscrew is pivoted and supported in an axially unmovable manner, by the hinge arm being provided with a cutout in its leg section in the area of the fastening screw and by the fastening screw engaging a hole located in the middle section of the bottom plate and being supported with its head on said bottom plate's edge.

In the hinge arm in accordance with the invention, the bottom plate tightens with its ends extending beyond the setscrew in the longitudinal direction of the hinge arm on the one hand the rear end section of the hinge arm and on the other hand the lower front side of the setscrew screwed into the hinge arm against the base plate, thus achieving an additional fastening directly also due to the fastening screw itself. By actuating the setscrew, the hinge arm can be adjusted in the desired angle position to the base plate or the support plate, the pressure on the rear end section of the hinge arm by the bottom plate being made even greater by actuating the setscrew in the sense of enlarging the angle of swivel.

Appropriately, the bottom plate supports itself with one rear end bent at an angle on the rear edge of the rectangular cutout of the leg section of the hinge arm. In this way, the step formed by the bending at an angle can simultaneously form a stop of the bottom plate on the edge of the cutout.

In accordance with a further preferred embodiment, it is provided that the hinge arm is provided in the rear section of its lateral shank with flat flutes and that the rear section of the bottom plate is held in grooves formed between the flat flutes and the leg section of the hinge arm.

In a further embodiment of the invention it is provided that the bottom plate comprises an elastic steel metal sheet. This embodiment provides the hinge arm in accordance with the invention with absorbing properties so that it can accept impacts made on it or on the door being supported by it in an elastically giving manner with an absorbent effect. The bottom plate can also comprise spring steel.

Appropriately, the rear supporting edge of the hinge arm is formed with a sharp edge. The sharp edge can cut into the base plate and thus form an exactly defined joint.

The supporting edge can consist of teeth located on the bottom side of the flat flutes.

Appropriately, the rear end of the bottom plate is supported on the hinge arm in the front section above the supporting edge so that this works on the supporting edge with a high force when the setscrew is actuated.

BRIEF DESCRIPTION OF THE DRAWINGS

Embodiments of the invention are described in more detail below by means of the drawings in which.

DESCRIPTION OF THE PREFERRED EMBODIMENTS

Figure 1:
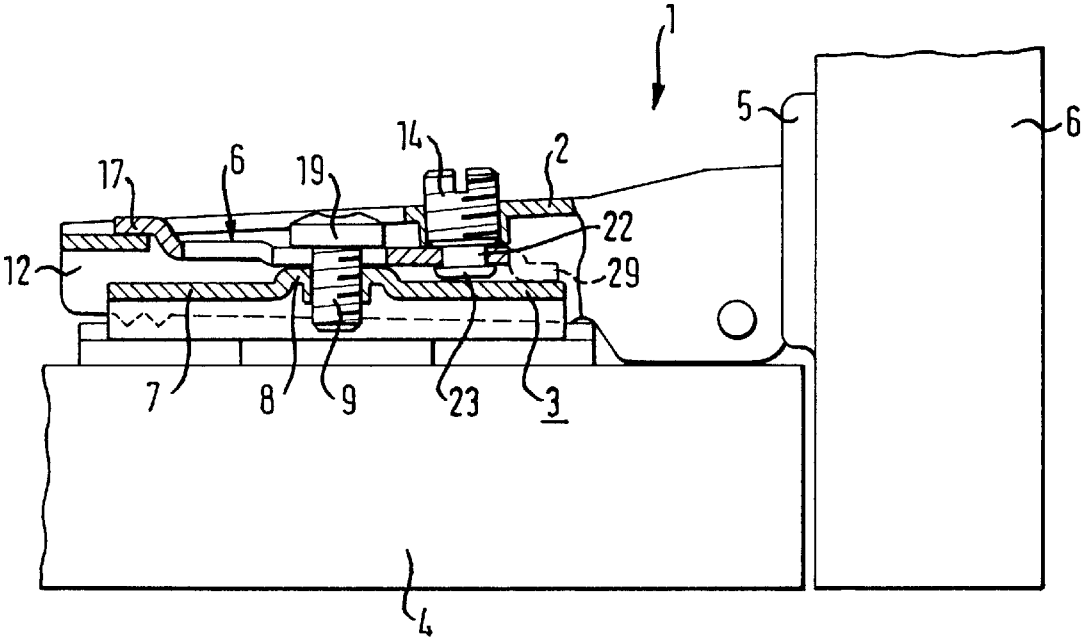
FIG. 1 shows a side view of a fitted hinge arm with a first embodiment of the hinge arm in accordance with the invention in the unadjusted state, partially in section.

In FIG. 1 a double guide hinge 1 can be seen whose hinge arm 2 is fastened to a base plate 3 which is fastened in a manner not shown to a support wall 4 of a piece of furniture by two fastening screws. The cup-shaped hinge part 5 of the hinge 1, which hinge part is connected in a conventional manner to the hinge arm 2 by two guides, is fastened in a reamed blind hole of a door 6 of a piece of furniture.

The base plate 3 is formed in a cross shape in top view and comprises a blank sheet metal part with elongated middle portion which supports by forming lateral steps a middle, rectangular elevation 7 extending essentially over its length. The middle elevations 7 is provided at its center with a further ramp-shaped elevation 8 in which a tapped hole with flanged edge has been made. The fastening screw 9 is screwed into the tapped hole.

On opposite sides of the elongated middle portion of the base plate 3 wing-shaped protrusions 10 opposing each other in a cross shape are located in which fastening boreholes consisting of oblong holes laterally to the longitudinal extension of the middle portion 3 have been made. The base plate is fastened by fastening screws screwed into these fastening boreholes to the support wall 4, the oblong holes allowing an adjustment of the hinge in the height of the piece of the furniture. The base plate can thus be formed symmetrically to its lateral and longitudinal center axes.

The hinge arm 2 comprises a blank sheet metal part with a U-shaped profile from the leg section 11 of which metal part the lateral shanks 12 are bent off. The leg section is provided in its middle section with a flanged tapped hole 13 in which the setscrew 14 is screwed. Furthermore, the leg section 11 is provided in its rear portion away from the joint with a rectangular cutout 15 to which a flat flute 36 extending freely backwards connects.

Figure 4:
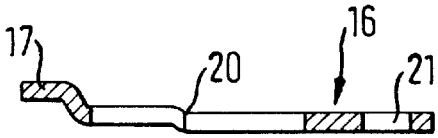
FIG. 4 illustrates a longitudinal section through a bottom plate.
Figure 5:
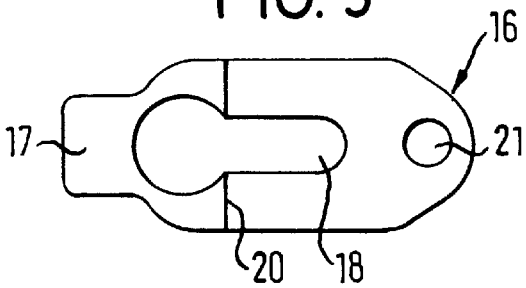
FIG. 5 illustrates a top view of the bottom plate of FIG. 4.

The bottom plate 16 seen in FIGS. 4 and 5 comprises a blank part made from steel sheet metal with an elongated broader middle portion with side edges parallel to one another and a narrower protrusion 17 bent at an angle. The middle portion is provided with a keyhole-shaped oblong hole 18. The diameter of the circular portion of the oblong hole 18 is slightly larger than the diameter of the head 19 of the fastening screw 9 so that the circular portion can be pushed over and off the head 19. The longer portion of the oblong hole 18 corresponds in its diameter to the threaded shaft of the fastening screw 9. A step 20 is formed between the longer portion and the circular portion of the oblong hole 18 so that in the fitted state of the hinge arm the head 19 of the fastening screw 9 is prevented from accidentally slipping from the longer portion into the circular portion of the oblong hole 18 and no unintentional loosening can occur.

On the end portion opposite the protrusion 17, the bottom plate 16 is provided with a borehole 21 which the setscrew 14 penetrates with a tapered, unthreaded shaft portion 22 which is provided on the under side of the bottom plate 21 with a rivet head 23 so that the setscrew 14 is held in a pivotable, but unmovable manner on the bottom plate 16.

In the fitted state, the bottom plate 16 is supported in the manner seen in FIG. 1 with its protrusion bent at an angle 17 on the flat flute 36 of the leg portion 11 of the hinge arm 2 so that the step of the protrusion 17 formed by the bending at an angle abuts the rear edge 24 of the rectangular cutout 15.

Figure 11:
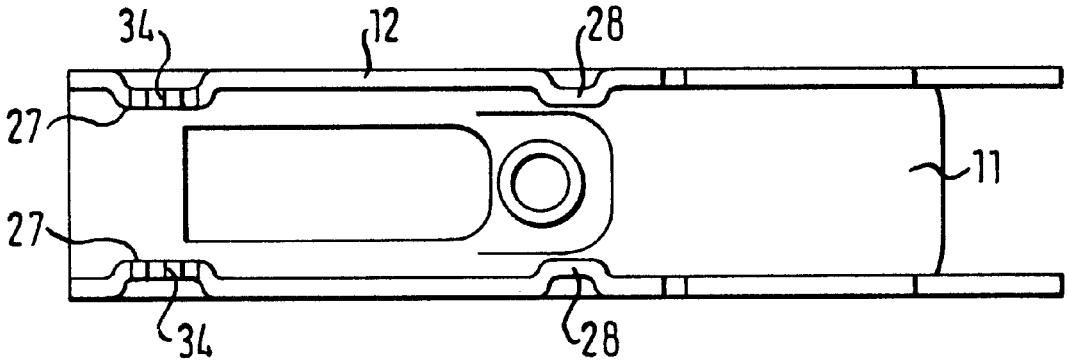
FIG. 11 illustrates a bottom view of the hinge arm of FIG. 8.
Figure 12:
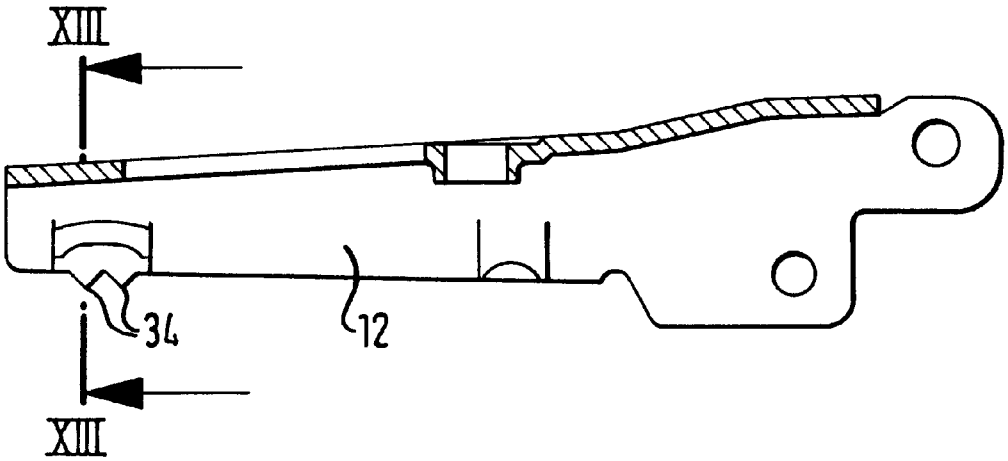
FIG. 12 illustrates a longitudinal section through the hinge arm of FIG. 11.
Figure 13:
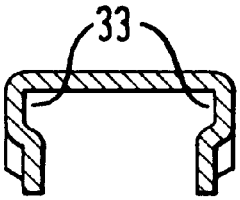
FIG. 13 a cross-section of the hinge arm along the line XIII—XIII in FIG. 12.

The side shanks 12 of the hinge arm 2 are provided in their rear end section with teeth 25 pointing downwards which are supported on a fluted surface 26 of the base plate. Furthermore, the shanks 12 possess a distance to each other whose width corresponds to the rectangular elevation 7 of the base plate 3 so that the hinge arm 2 is guided on the elevation. The shanks of the hinge arm can also be provided in the manner seen in FIG. 11 with lateral flat flutes 27, 28 which are supported on the side flanks of the elevation 7 and take over the guidance of the hinge arm on the elevation 7.

The hinge arm 2 is held on the base plate 3 by the fastening screw 9 and the bottom plate 16. Thanks to the fastening screw 9, the bottom plate 16 is given initial tension in the direction of the base plate 3 so that the rear end bent at an angle 17 of the bottom plate presses the rear end of the hinge arm against the base plate 3. The pressure is exerted roughly above the teeth 25 so that a secure fixing of the rear end section of the hinge arm on the base plate is achieved. The front section of the bottom plate 16 holds the rivet head 23 of the setscrew 14 in abutment to the base plate so that in this way the front section of the hinge arm 2 is also fixed.

Figure 2:
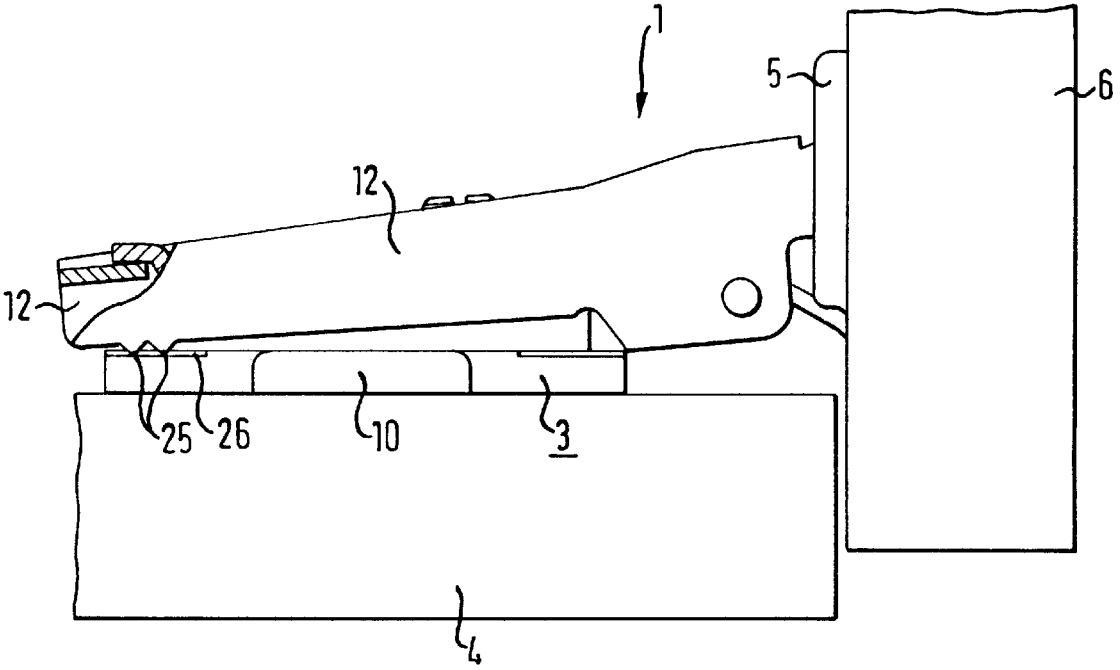
FIG. 2 illustrates a side view of the hinge arm of FIG. 1 in the adjusted state.
Figure 3:
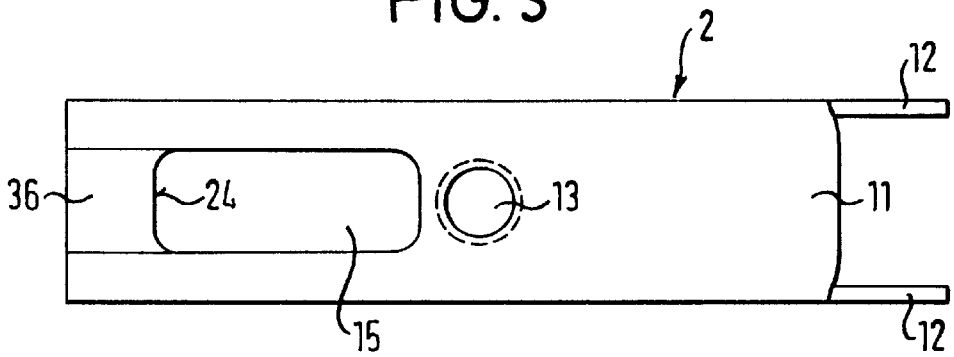
FIG. 3 illustrates a top view of the hinge arm of FIG. 1.

In the representation seen in FIG. 1, the hinge arm 2 is in its unadjusted base position. If a side adjustment of the door is to be made, the setscrew 14 is screwed in so that the side adjustment visible in FIG. 2 is given. In this side adjustment, the pressure exerted by the bottom plate 16 is further increased by a corresponding swivelling of the hinge arm.

Figure 6:
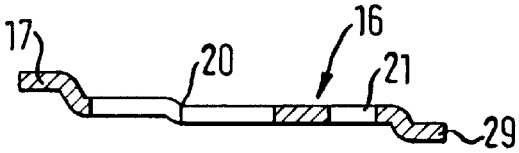
FIG. 6 illustrates a longitudinal section through a modified form of a bottom plate.
Figure 7:
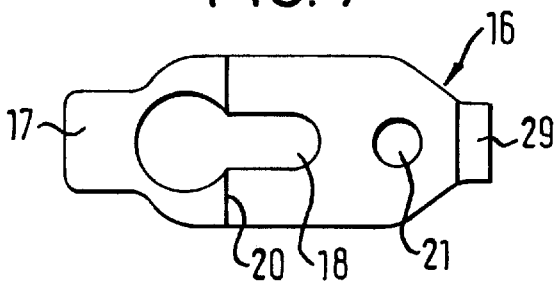
FIG. 7 illustrates a top view of the bottom plate of FIG. 6.
Figure 8:
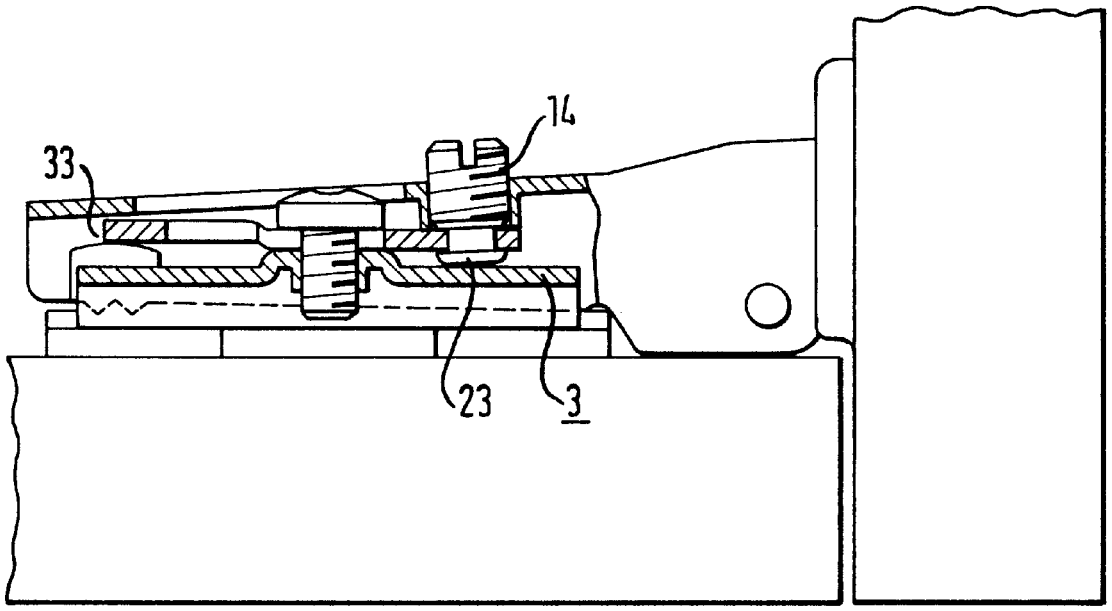
FIG. 8 illustrates a side view of a fitted hinge arm with a third embodiment of the hinge arm in accordance with the invention, partially in section.
Figure 9:
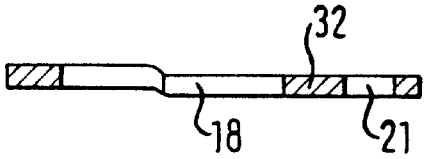
FIG. 9 illustrates a longitudinal section through the bottom plate seen in FIG. 8.
Figure 10:
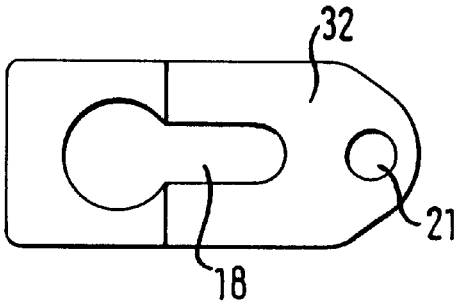
FIG. 10 illustrates a top view of the bottom plate of FIG. 9.

In the embodiment in accordance with FIGS. 6 and 7, the bottom plate 16 is also provided on its front end with a bend at an angle 29 so that the bottom plate does not support itself on the base plate 3 in the manner indicated by a broken line in FIG. 1 via the rivet head 23, but via the bend at an angle 29.

The embodiment in accordance with FIGS. 8 to 13 differs from that in accordance with FIGS. 1 to 7 essentially only in that the bottom plate 32 is pushed with its rear end section into the grooves 33 which are formed between the flat flutes 27 in the side shanks 12 and the leg portion 11 of the hinge arm. The flat flutes 27 are provided on their bottom side with teeth 34 which are supported on the fluted surface of the base plate 3 and equally grip on this while forming a swivel joint.

I claim:

1. An adjustable hinge arm (2) having a U-shaped profile, which hinge arm is supported through a bottom plate (16, 32) on a base plate (3) which can be fastened on a wall (4) or similar structure, at a rear end section of the hinge arm (2) remote from a joint in a hinge structure formed therewith and a set screw (14) screwed into the hinge (2) and a fastening screw (9, 19) being screwed into the base plate (3), wherein at the rear end section of the hinge arm (2), a rear end of the bottom plate (16, 32) is supported and on a front end of the bottom plate (16, 32) the set-screw (14) is pivoted and supported in an axially unmovable manner, the hinge arm (2) is provided in the area of the fastening screw (9, 19) with a cut-out (15) in a leg portion (11) thereof, the fastening screw (9, 19) engages a hole (18) in a middle section of the bottom plate (16, 32) and is supported by a head (19) of the fastening screw on an edge of the bottom plate (16, 32), and the bottom plate (16, 32) is supported with the rear end (17) thereof bent at an angle on a rear edge (24) of the cutout (15) of the leg portion (11) of the hinge arm (2).

2. A hinge arm in accordance with claim 1, wherein its side shanks (12) are provided in their rear sections with flat flutes (27) and wherein the rear section of the bottom plate (32) is held in grooves (33) formed between the flat flutes (27) and the leg portion (11) of the hinge arm (2).

3. A hinge arm in accordance with claim 2, wherein a rear support edge (25, 34) of the hinge arm (2) is formed with a sharp edge.

4. A hinge arm in accordance with claim 3, wherein the support edge consists of teeth (34) located on the bottom side of the flat flutes (27).

5. A hinge arm in accordance with claim 4, wherein the bottom plate (16, 32) tightens with its ends extending beyond the setscrew (9, 19) in the longitudinal direction of the hinge arm (2) on the one hand the rear end section of the hinge arm (2) and on the other hand the lower front side of the setscrew (14) screwed into the hinge arm (2) or a portion bent at an angle or bent down from the bottom plate against the base plate (3).

6. A hinge arm in accordance with claim 3, wherein the rear end of the bottom plate (16, 32) is supported on the hinge arm (2) in the front section above the support edge (25, 34).

7. A hinge arm in accordance with claim 2, wherein the bottom plate (16, 32) tightens with its ends extending beyond the setscrew (9, 19) in the longitudinal direction of the hinge arm (2) on the one hand the rear end section of the hinge arm (2) and on the other hand the lower front side of the setscrew (14) screwed into the hinge arm (2) or a portion bent at an angle or bent down from the bottom plate against the base plate (3).

8. A hinge arm in accordance with claim 2, wherein the bottom plate (16) is supported directly on the base plate (3).

9. A hinge arm in accordance with claim 8, wherein the bottom plate (16) is supported by a front end (29) bent at an angle, directly on the base plate (3).

10. A hinge arm in accordance with claim 1, wherein the bottom plate (16) is supported directly on the base plate (3).

11. A hinge arm in accordance with claim 10, wherein the bottom plate (16) is supported by a front end (29) bent at an angle, directly on the base plate (3).

12. A hinge arm in accordance with claim 10, wherein the bottom plate (16, 32) tightens with its ends extending beyond the setscrew (9, 19) in the longitudinal direction of the hinge arm (2) on the one hand the rear end section of the hinge arm (2) and on the other hand the lower front side of the setscrew (14) screwed into the hinge arm (2) or a portion bent at an angle or bent down from the bottom plate against the base plate (3).

13. A hinge arm in accordance with claim 1, wherein the bottom plate (16, 32) consists of elastic steel sheet metal.

14. A hinge arm in accordance with claim 1, wherein the bottom plate (16) is supported directly on the base plate (3).

15. A hinge arm in accordance with claim 14, wherein the bottom plate (16) is supported by a front end (29) bent at an angle, directly on the base plate (3).

16. A hinge arm in accordance with claim 1, wherein a rear support edge (25, 34) of the hinge arm (2) is formed with a sharp edge.

17. A hinge arm in accordance with claim 1, wherein the bottom plate (16, 32) tightens with its ends extending beyond the setscrew (9, 19) in the longitudinal direction of the hinge arm (2) on the one hand the rear end section of the hinge arm (2) and on the other hand the lower front side of the setscrew (14) screwed into the hinge arm (2) or a portion bent at an angle or bent down from the bottom plate against the base plate (3).

18. A hinge arm in accordance with claim 1, wherein the bottom plate (16, 32) also tightens with its ends extending beyond the setscrew (9, 19) in the longitudinal direction of the hinge arm (2) the lower front side of the setscrew (14) screwed into the hinge arm (2) or a portion bent at an angle or bent down from the bottom plate against the base plate (3).

19. A hinge arm in accordance with claim 1, wherein the hole (18) in the middle section of the bottom plate (16, 32) is oblong-shaped in the form of a keyhole, and a step (20) is formed between a longer portion and a circular portion of the oblong, keyhole-shaped hole (18) so that upon coupling, the head (19) of the fastening screw (19) is prevented from accidentally slipping from the longer portion into the circular portion of the oblong, key hole-shaped hole (18) and no unintentional loosening can occur.

20. A hinge arm in accordance with claim 1, wherein the cutout (15) is rectangular.

* * * * *